United States Patent [19]

Ishikawa et al.

[11] 4,448,181

[45] May 15, 1984

[54] PLASMA IGNITION SYSTEM FOR AN INTERNAL COMBUSTION ENGINE

[75] Inventors: Yasuki Ishikawa; Hiroshi Endo; Masazumi Sone; Iwao Imai, all of Yokosuka, Japan

[73] Assignee: Nissan Motor Company, Limited, Kanagawa, Japan

[21] Appl. No.: 386,782

[22] Filed: Jun. 7, 1982

[30] Foreign Application Priority Data

Jun. 9, 1981 [JP] Japan ..... 56-87443

[51] Int. Cl.[3] ..... F02P 3/08

[52] U.S. Cl. ..... 123/620; 123/596; 123/598; 123/643

[58] Field of Search ..... 123/143 B, 620, 643, 123/605, 596, 598

[56] References Cited

U.S. PATENT DOCUMENTS

| | | | |
|---|---|---|---|
| 3,788,293 | 1/1974 | Anderson | 123/620 |
| 4,122,816 | 10/1978 | Fitzgerald et al. | 123/598 |
| 4,301,782 | 11/1981 | Wainwright | 123/620 |
| 4,366,801 | 1/1983 | Endo et al. | 123/620 |
| 4,369,757 | 1/1983 | Anzai | 123/620 |

FOREIGN PATENT DOCUMENTS

| | | | |
|---|---|---|---|
| 1371042 | 10/1974 | United Kingdom | 123/605 |

*Primary Examiner*—Andrew M. Dolinar

*Attorney, Agent, or Firm*—Lowe, King, Price & Becker

[57] ABSTRACT

A plasma ignition system for an engine having any number of engine cylinders, which comprises: (A) a plurality of plasma ignition plugs each mounted within a corresponding engine cylinder; (B) a first power supply unit for supplying a first electric power into each plasma ignition plug so as to generate a spark discharge within each plasma ignition plug; (C) a first switching circuit for sequentially connecting the first power supply unit to each plasma ignition plug according to a predetermined ignition order; (D) a second power supply unit for supplying a second electric power into each plasma ignition plug so as to generate a high-temperature plasma gas within each plasma ignition plug; and (E) a second switching circuit for sequentially connecting two of the plasma ignition plugs within the respective engine cylinders, one engine cylinder being at the start of an explosion stroke and the other engine cylinder being at almost end of an exhaust stroke, in a predetermined delay after the occurrence of the spark discharge at the corresponding plasma ignition plug when the engine speed is below a predetermined value, so that the number of high-voltage withstanding characteristic capacitors and switching elements (thyristors) of the switching circuits can be reduced half that of engine cylinders and the power consumption of these first and second power supply units can be saved remarkably particularly when the engine speed exceeds the predetermined value, e.g., 3000 r.p.m.

18 Claims, 6 Drawing Figures

DC - DC CONVERTER
Da
TO ANODES OF D11
DC - DC CONVERTER
Db
TO ANODES OF D13
12V
B
MONO STABLE M.V.
11
COMP.
13
F/V CONV.
12
CRANK ANGLE SENSOR
1
4-BIT RING COUNTER
2
MONOSTABLE MULTIVIBRATORS
8a
8b
8c
8d
a
b
c
d
OR1
9a
OR2
9b
AND1
14a
AND2
14b
DELAY1
10a
DELAY2
10b
TO SCR15 e
TO SCR16 f

PLASMA IGNITION SYSTEM FOR AN INTERNAL COMBUSTION ENGINE

BACKGROUND OF THE INVENTION

1. Field of the Invention

The present invention relates generally to a plasma ignition system for an internal combustion engine having a plurality of engine cylinders and particularly to a plasma ignition system having (1) a power supply for supplying electric power to start a spark discharge in each plasma ignition plug and (2) a switching circuit for operatively connecting the power supply to each plasma ignition plug wherein the supply and circuit are separate from another power supply for supplying a large amount of electric power to continue an arc discharge subsequent to the spark discharge in each plasma ignition plug in order to provide high-temperature plasma gas combustion of a compressed air-fuel mixture in the corresponding engine cylinder and another switching circuit for operatively connecting the latter power supply to each plasma ignition plug, the number of the latter power supply being half that of the engine cylinders.

SUMMARY OF THE INVENTION

It is an object of the present invention to provide a plasma ignition system for an internal combustion engine having a plurality of engine cylinders in each of which a plasma ignition plug is mounted.

Another object of the present invention is to separately control the application of high DC voltages derived from individual power supply units to both the spark discharge and arc discharge (which results in generation of high-temperature plasma gas) of plasma ignition plugs of the plasma ignition system.

It is a further object of the present invention to separately control the application of high DC voltages derived from individual power supply units to both the spark discharge and arc discharge of plasma ignition plugs of a plasma ignition system in an automotive vehicle in response to a vehicle operating condition, such as vehicle or engine speed.

A first power supply unit supplies sufficient electric power to generate a spark discharge in each plasma ignition plug. Switching circuitry operatively connects the first power supply unit to the corresponding plasma ignition plug according to a predetermined ignition order. A second power supply unit supplies sufficient electric power to generate an arc discharge subsequent to the spark discharge. The arc discharge results in a high-temperature plasma gas being injected to achieve complete combustion of the air-fuel mixture. Additional switching circuitry operatively connects the power supply unit to the plasma ignition plug. The number of switching circuit units of the additional switching circuitry is half that of the engine cylinders so that ignition for the compressed air-fuel mixture can be achieved at all engine operating conditions, and a small-sized and inexpensive ignition system can also be achieved.

BRIEF DESCRIPTION OF THE DRAWINGS

The features and advantages of the present invention will be fully understood from the foregoing description and the attached drawings in which like reference numerals designate corresponding elements and in which.

DETAILED DESCRIPTION OF THE PREFERRED EMBODIMENTS

Reference is hereinafter made to the attached drawings and first to FIG. 1, longitudinally sectioned and bottom views (X and Y) of a plasma ignition plug to be mounted in an engine cylinder.

Figure 1:
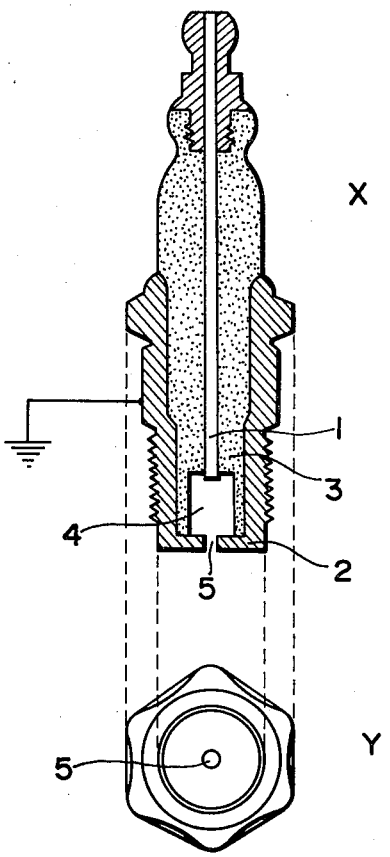
FIG. 1 includes cross section and top views of a typical plasma ignition plug used for a plasma ignition system according to the present invention.

In FIG. 1, are illustrated a central electrode 1 and a grounded side electrode 2. An insulating member 3, e.g., a ceramic is provided between the central and side electrodes 1 and 2. Furthermore, a discharge gap 4 of small volume is formed at lower ends of both the insulating member 3 and central electrode 1 so that the central electrode 1 faces the side electrode 2 and a jet hole 5 is also provided below the discharge gap 4 through the bottom center of the side electrode 2. Hole 5 injects a high-temperature plasma gas, generated at the discharge gap 4, into a combustion chamber in which the plasma ignition plug shown in FIG. 1 is mounted. The high temperature plasma ignites an air-fuel mixture in the chamber.

Figure 2:
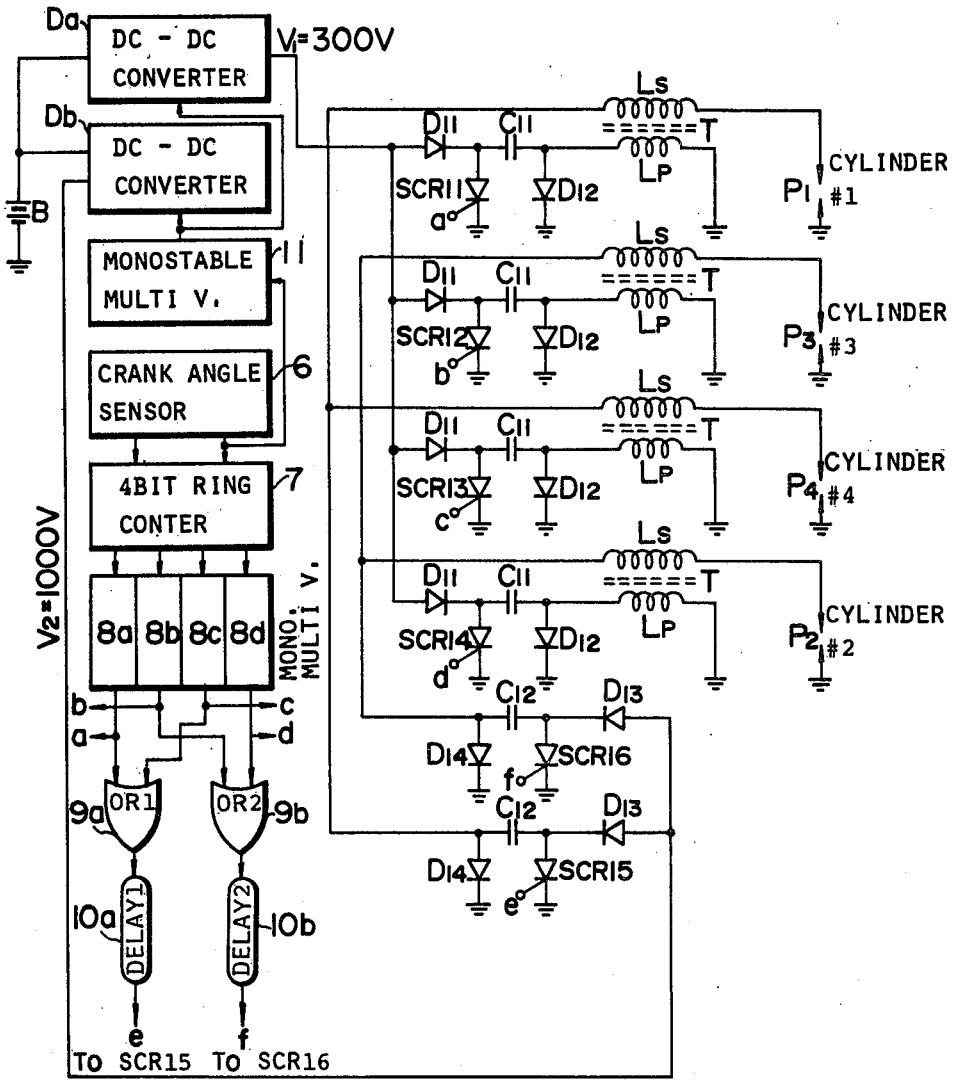
FIG. 2 shows a first preferred embodiment of a four-cylinder engine plasma ignition system according to the present invention.

FIG. 2 is an overall circuit diagram of a first preferred embodiment of a plasma ignition system according to the present invention, representatively applied to a four-cylinder engine.

It should be noted that the plasma ignition system according to the present invention can be applied equally well to any number of engine cylinders.

In FIG. 2, a first DC—DC converter Da inverts a low DC voltage (e.g., 12 V) from a DC voltage supply, such as a vehicle battery B, into a corresponding AC voltage by an oscillatory action and converts the AC voltage into a relatively high DC voltage (e.g., 300 V). An output terminal of the first DC—DC converter Da is connected to a plurality of first capacitors $C_{11}$ via first diodes $D_{11}$, the number of which corresponds to that of the first capacitors $C_{11}$. The capacitance of each first capacitor $C_{11}$ is about 0.2 microfarads. Each first capacitor $C_{11}$ is connected to a primary winding Lp of a corresponding transformer T. The number of transformers T is equal to that of the first capacitors $C_{11}$, i.e., that of plasma ignition plugs $P_1$ through $P_4$. The sequencial number of the plasma ignition plugs $P_1$ through $P_4$ corresponds to that of the engine cylinders. The ignition order of the plugs $P_1$ through $P_4$ is determined previously as $P_1$, $P_3$, $P_4$, and $P_2$. Each first capacitor $C_{11}$ is connected to a second diode $D_{12}$. One of thyristors SCR11 through SCR14 is respectively connected between a corresponding first capacitor $C_{11}$ and ground. Each thyristors SCR11 through SCR14 serves as a first switching circuit. One end of each primary winding Lp of a transformer T and side electrode 2 of the plasma ignition plug $P_1$ through $P_4$ are grounded. A crank angle sensor 6 detects half a rotation of a crankshaft of the engine, i.e., 180° rotation of the crankshaft, and produces a first pulse signal having a period corresponding to 180° rotation of the crankshaft, i.e., engine. Sensor 6 also produces a second pulse signal having a period corresponds to 720° rotation (two rotations) of the crankshaft, i.e., engine. The rotation through 720° of the engine is one engine cycle of any number of cylinders. In the case of a six-cylinder engine, the period of the first pulse signal corresponds to a 120° rotation of the engine and in the case of a eight-cylinder engine, the period thereof corresponds to a 90° rotation of the engine. A four-bit ring counter 7, connected to the crank angle sensor 6, receives the first pulse signal derived from the crank angle sensor 6. Counter 7 sequentially supplies a third pulse signal to each of monostable multivibrators 8*a* through 8*d*, and is reset in response to derivation of the second pulse signal from the crank angle sensor 6. In the case of the six-cylinder engine, the counter is a six-bit ring counter.

The output terminals of first, second, third and fourth monostable multivibrators 8*a* through 8*d* are connected to the respective gate terminals of the thyristors SCR11 through SCR14. The output terminals of the first and third monostable multivibrators 8*a* and 8*c* are connected to a first OR gate circuit 9*a* and the output terminals of the second and fourth monostable multivibrators 8*b* and 8*d* are connected to a second OR gate circuit 9*b*. The output terminal of the first and second OR gate circuit 9*a* and 9*b* are respectively connected to first and second delay circuits 10*a* and 10*b*. Ignition pulse signals a–d (FIG. 6), respectively derived from monostable multivibrators 8*a*–8*d*, are supplied to the corresponding gate terminals of the thyristors SCR11–SCR14 with a predetermined ignition timing so as to turn on the corresponding thyristors SCR11–SCR14. The pulse width of each of ignition pulse signals a–d is approximately 100 microseconds. When each of thyristors SCR11–SCR14 turns on, the corresponding diode $D_{12}$ is in a floating state with respect to the ground.

Next, a second DC—DC converter Db inverts the low DC voltage from the battery B into a corresponding AC voltage and converts the AC voltage into a relatively high DC voltage, e.g., about 1000 volts. The output terminal of the second DC—DC converter Db is connected to two second capacitors $C_{12}$ via the respective diodes $D_{13}$. It should be noted that the number (two) of the second capacitors $C_{12}$ is one-half the number of engine cylinders. Each second capacitor $C_{12}$ is also connected between a corresponding fourth diode $D_{14}$, the second capacitors are respectively also connected to corresponding second thyristors SCR15 and SCR16, each of which functions as a second switching circuit. Furthermore, each second capacitor $C_{12}$ is connected via a separate secondary winding Ls of the corresponding transformer T to the central electrode of a separate corresponding plasma ignition plug $P_1$–$P_4$. Each of transformers T has an iron core. Gate terminals e and f of thyristors SCR15 and SCR16 are respectively connected to the first and second delay circuits 10*a* and 10*b*.

Second capacitor $C_{12}$, connected to the thyrister SCR16, is also connected to the respective plasma ignition plugs in the third and second cylinders, while the other second capacitor $C_{12}$, connected to thyristor SCR15, is also connected to the respective plasma ignition plugs in the first and fourth cylinders.

The first cylinder is at the start of an ignition cycle when the fourth cylinder is almost at the end of an engine exhaust stroke and vice versa; the second cylinder is at the start of an ignition cycle when the third cylinder is almost at the end of the engine exhaust stroke and vice versa.

The gate terminal of thyristor SCR15 receives a first trigger pulse signal e from the first delay circuit 10*a*. The width of the first trigger pulse signal e is about 100 microseconds, the same as the widths of the output pulse signals a and c of the first and third monostable multivibrators 8*a* and 8*c*. The timing of pulse signal e is such that pulse e occurs 100 microseconds later than the respective ignition start timings of the first and fourth cylinders through the use of the first delay circuit 10*a*.

In the same way, the gate terminal of thyristor SCR16 receives a second trigger pulse signal f from the second delay circuit 10*b*. The width of the second trigger pulse signal f is about 100 microseconds, the same as the respective output pulse signals b and d of the second and fourth monostable multivibrators 8*b* and 8*d*; the timing of signal f is such that the pulse occurs 100 microseconds later than the respective ignition start timings of the second and third cylinders through the use of the second delay circuit 10*b*.

On the other hand, a fifth monostable multivibrator 11 is connected between the crank angle sensor 6 and the first and second DC—DC converts Da and Db. The fifth monostable multivibrator 11 derives a plulse signal having a constant width (1 millisecond) whenever the first pulse signal (180° signal) is supplied by the crank angle sensor 6 to the first and second DC—DC converters Da and Db so that each oscillatory action for inverting the low DC voltage into the corresponding AC voltage is halted after a time interval (1 millisecond) equal to the width of the output pulse signal from the fifth monostable multivibrator 11, at the start of each plasma ignition. Consequently, the power consumption from the battery B is relatively low.

Figure 6:
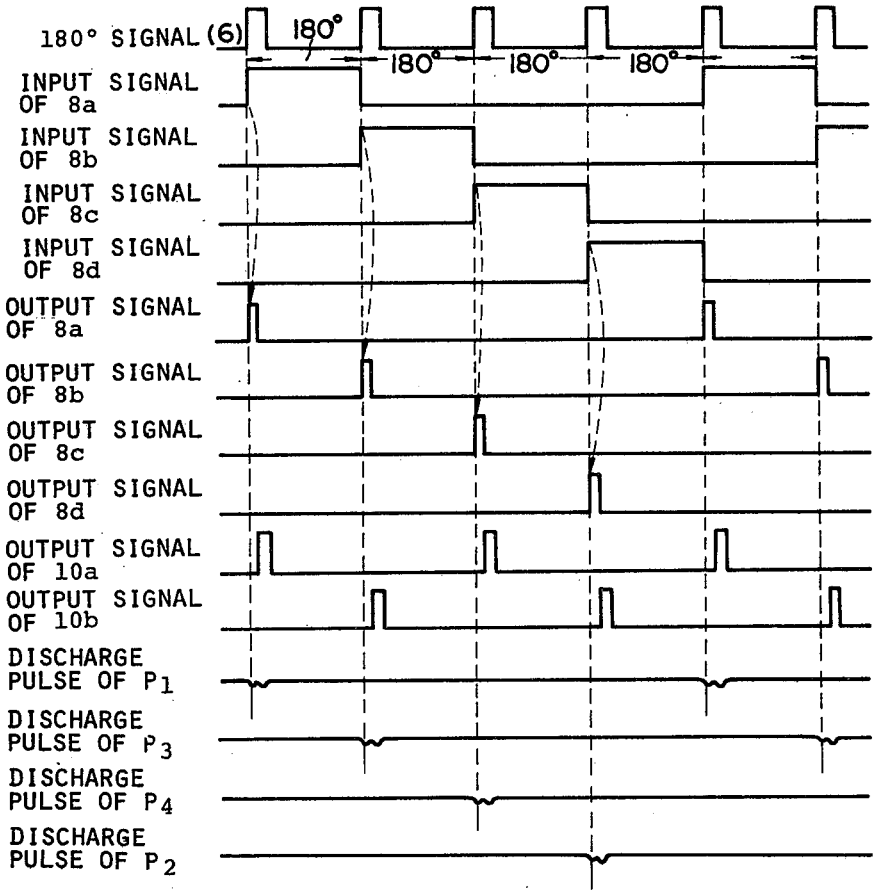
FIG. 6 is a signal waveform timing chart for each circuit shown in the first preferred embodiment of FIG. 2

The timing of the leading and trailing edges of each pulse signal described supra is described with reference to FIG. 6.

The high voltage DC output from the first and second DC—DC converters Da and Db completely charge the first and second capacitors $C_{11}$ and $C_{12}$ via the first and third diodes $D_{11}$ and $D_{13}$, respectively.

For example, the thyristor SCR11 turns on in response to the first ignition pulse signal a being supplied to the gate thereof by the first monostable multivibrator 8*a*. An electric charge on the corresponding first capacitor $C_{11}$ is discharged through the thyristor SCR11 to the primary winding Lp of the transformer T. Hence, the DC voltage applied across the primary winding Lp is boosted by the transformer so the voltage at the secondary winding Ls is relatively high, e.g., −15 kV with respect to ground; the secondary winding voltage is determined by the turns ratio of the windings. Consequently, the first plasma ignition plug $P_1$ generates spark discharge at the discharge gap 4 and a consequent electric breakdown occurs due to the application of minus 15 kilovolts across the side and central electrodes 2 and 1. The resistance between the central and side electrodes 1 and 2 is, therefore, greatly reduced to substantially zero. 100-microseconds later, upon the occurrence of the spark discharge, the first trigger pulse signal e from the first delay circuit 10*a* is applied to the gate terminal of the thyristor SCR15 to turn on the thyristor. When the thyristor SCR15 turns on, electric charge on the second capacitor $C_{12}$, connected to thyristor SCR15 and storing a large amount of energy (about 0.5 Joules), is fed to the first plasma ignition plug $P_1$ in which the spark discharge has already occurred. Therefore, the first plasma ignition plug $P_1$ generates an arc discharge that injects, into the first cylinder, a high temperature plasma gas generated within the discharge gap 4. Consequently, the compressed air-fuel mixture is ignited completely without failure (misfire). In this case, the electric charge on the second capacitor $C_{12}$ connected to thyristor SCR15 is also fed to the fourth ignition plug $P_4$ through the corresponding secondary winding Ls of the transformer T. However, the fourth cylinder is almost at the start of a suction stroke so that the fourth plasma ignition plug $P_4$ cannot instigate a plasma discharge since the corresponding thyristor SCR13 is not turned on. The resulting high impedance in the primary winding circuit including thyristor SCR13 prevents discharge of capacitor C11 connected to thyristor SCR13 so the fourth plasma ignition plug $P_4$ can not generate a spark discharge.

Since the oscillation action of the first DC—DC converter Da is halted temporarily, when the thyristor SCR11 is turned on, due to the output pulse signal of the fifth multivibrator 11 as described above, the thyristor SCR11 returns to an original turn off state upon the completion of the discharge operation from the corresponding first capacitor 11 due to the damped oscillation between the corresponding first capacitor $C_{11}$ and primary winding Lp of the corresponding transformer T.

Thyristor SCR15 also returns to an original turn off state upon the completion of the discharge operation of the corresponding second capacitor $C_{12}$.

In this way, a plasma ignition sequence is carried out in the remaining cylinders as described for the first cylinder. The plasma ignition sequence is in a predetermined order, so the spark discharge occurs due to the discharge from the corresponding first capacitors $C_{11}$ through each of thyristors SCR12, SCR13, and SCR14 and the high energy is subsequently coupled to the plugs due to the discharges from the corresponding second capacitors $C_{12}$ through each of thyristors SCR15 and SCR16.

In the first preferred embodiment shown in FIG. 2, the plasma ignition system uses two separate DC—DC converters Da and Db and two separate groups of the capacitors $C_{11}$ and $C_{12}$ for charging the relatively high DC voltage (300 volts) from the first DC—DC converter Da and for charging the still higher DC voltage (1000 volts) from the second DC—DC converter Db. Such an arrangement enables at least the first DC—DC converter Da to completely provide the high DC voltage for each first capacitor $C_{11}$. In turn, each of capacitors $C_{11}$ completely charges the high DC voltage from the first capacitor $C_{11}$ even when the engine rotates at a high speed. Therefore, ignition of an air-fuel mixture supplied to the plugs is achieved, as is stable combustion under every engine operating condition. In addition, since the number of thyristors SCR15 and SCR16 and second capacitors $C_{12}$, each having a high-voltage withstanding characteristic, is half that of the engine cylinders, the plasma ignition system has a small size and is relatively inexpensive.

Figure 3:
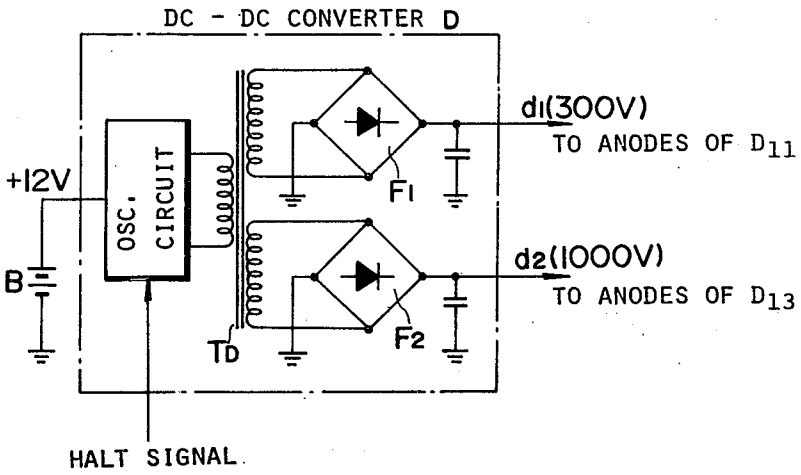
FIG. 3 is a circuit diagram of a DC-DC converter used in a second preferred embodiment of the plasma ignition system according to the present invention.

FIG. 3 is an internal circuit block diagram of a DC—DC converter D used in a second preferred embodiment of the plasma ignition system.

In FIG. 3, the DC—DC converter D comprises: (a) oscillation circuit which inverts the low DC voltage (12 volts) from the battery B into a corresponding AC voltage; (b) a transformer $T_D$ which boosts the AC voltage to pair of higher-amplitude AC voltages at the secondary windings thereof; (c) a first (full-wave) rectifying circuit $F_1$ which rectifies the high AC voltage across one of the secondary windings of transformer $T_D$ into the corresponding DC voltage (300 volts) at the output terminal $d_1$ thereof; (d) a second (full-wave) rectifying circuit $F_2$ which rectifies the high AC voltage across the other secondary winding of transformer $T_D$ into the corresponding high DC voltage (1000 volts) at the output terminal $d_2$ thereof. The output terminal of the first rectifying circuit $F_1$ is connected via the respective first diodes $D_{11}$ to the first capacitors $C_{11}$ as shown in FIG. 2. The output terminal of the second rectifying circuit $F_2$ is, on the other hand, connected via the respective third diodes $D_{13}$ to the second capacitors $C_{12}$ as shown in FIG. 2. The oscillation circuit is also connected to respond to a halt terminal of the fifth monostable multivibrator 11 shown in FIG. 2. The operation is the same as described hereinabove with reference to FIG. 2.

In the second preferred embodiment, since the DC—DC converter D serves as the first and second DC—DC converters Da and Db, the size of the plasma ignition system becomes smaller.

Figure 4:
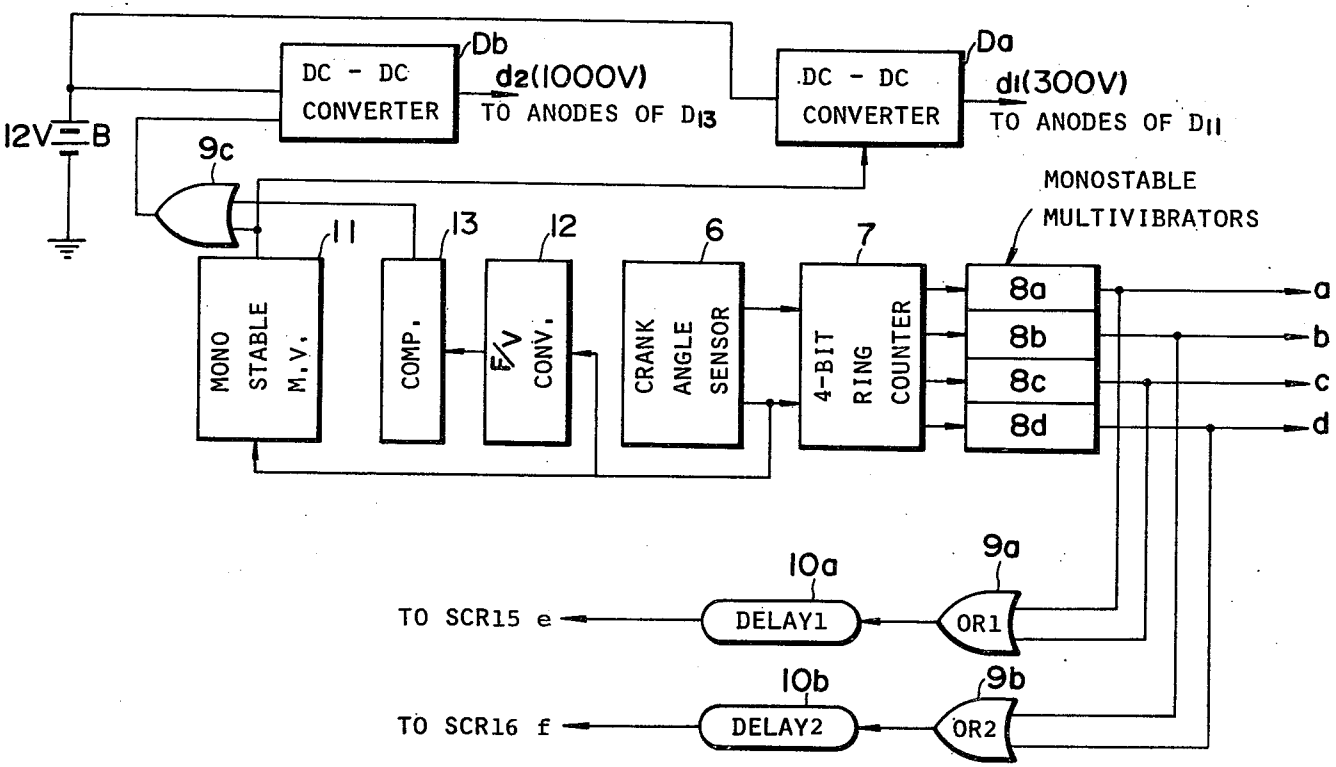
FIG. 4 is a block diagram of a third preferred embodiment of the four-cylinder engine plasma ignition system according to the present invention.

FIG. 4 is a block diagram of a third preferred embodiment of the plasma ignition system.

In FIG. 4, the first pulse signal (180° signal) from the crank angle sensor 6 is supplied to a frequency-to-voltage converter 12 (hereinafter simply referred to as F/V converter), which derives a voltage level corresponding to the frequency of the first pulse signal. The voltage level corresponding to the engine speed is compared with a reference voltage corresponding to a predetermined engine speed (e.g., 3000 r.p.m.) by comparator 13, connected to respond to the output of F/V converter 12. The comparator 13 derives a high-level voltage signal corresponding to a positive logic level "1" whenever the voltage signal from the F/V converter 12 exceeds the refrence voltage. The output terminal of the comparator 13 is connected to a third OR gate circuit 9c, also responsive to the fifth monostable multivibrator 11. The output terminal of the third OR gate circuit 9c is connected to the oscillation halt terminal of the second DC—DC converter Da as shown in FIG. 2. Therefore, when the high voltage signal corresponding to the positive logic "1" is coupled from the comparator 13 through the third OR gate 9c, the oscillation action of the second DC—DC converter Db halts and the converter does not supply the high DC voltage (1000 volts) to each of second capacitors $C_{12}$. Consequently, the plasma ignition plugs $P_1$ through $P_4$ do not receive the high energy to be discharged from the respective second capacitors $C_{12}$ when the engine speed exceeds a predetermined value (300 rpm) corresponding to the reference voltage of the comparator 13. However, in such a high speed region, when the predetermined value of engine speed, is exceeded the plasma ignition plugs can fire the compressed air-fuel mixture supplied to the respective engine cylinders. In such a region a small amount of energy (about 0.1 joule) sufficient to generate only the spark, is fed from the respective first capacitors $C_{11}$.

Therefore, the power consumption of the battery B is considerably reduced, as is the fuel consumption. The construction of the plasma ignition system of FIG. 4, other than the additional circuits described above, is the same as described hereinbefore with reference to FIG. 2.

Figure 5:
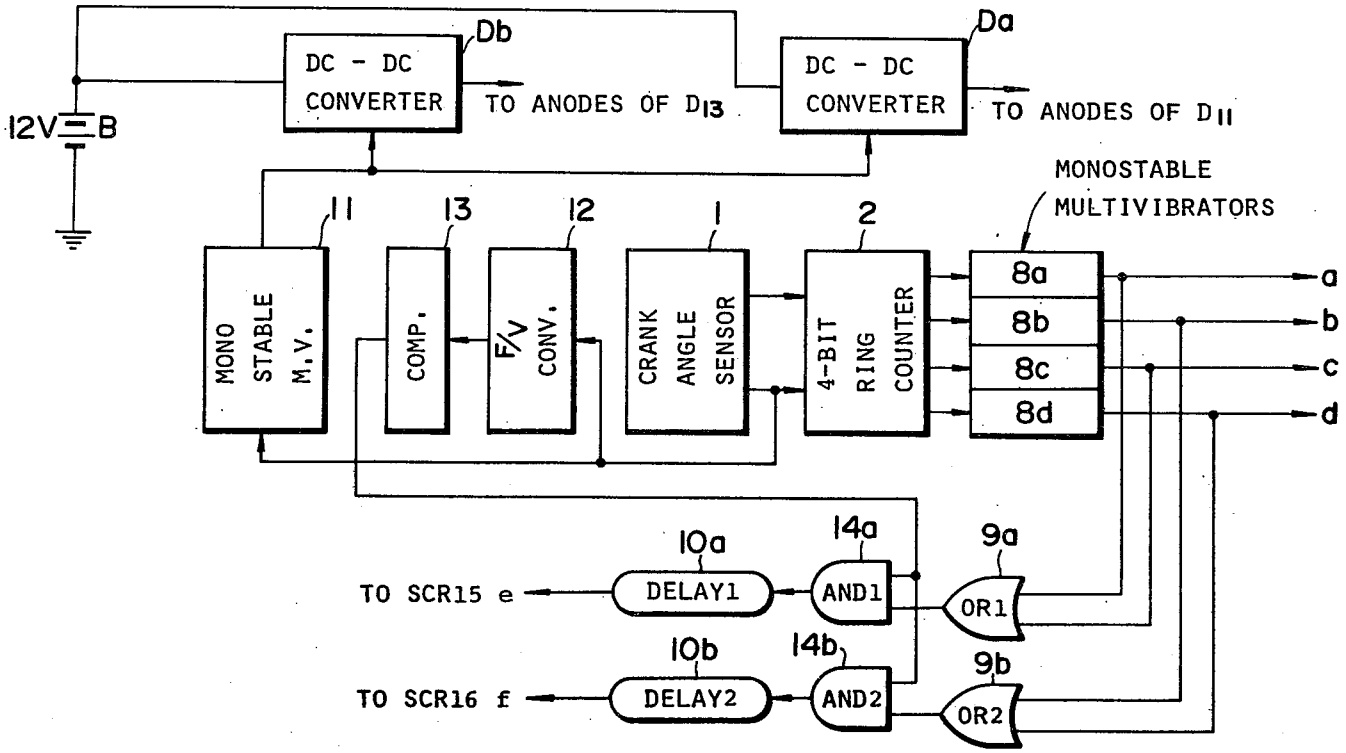
FIG. 5 is a block diagram of a fourth preferred embodiment of the four-cylinder plasma ignition system according to the present invention.

FIG. 5 is a block diagram of fourth preferred embodiment of the plasma ignition system wherein the output trigger signals from the first, second, third, and fourth monostable multivibrators 8*a* through 8*d*, also shown in FIG. 2, are disabled by a low level signal corresponding to a positive logic "0" from the comparator 13'.

The comparator 13' derives the low level signal whenever the engine speed exceeds a predetemined value (3000 rpm), i.e., the output voltage signal from the F/V converter 12 exceeds the reference voltage, which differs from the third preferred embodiment shown in FIG. 4.

Therefore, first and second AND gate circuits 14*a* and 14*b* are electrically connected between the first and second OR gate circuits 9*a* and 9*b* and first and second delay circuits 10*a* and 10*b*, respectively. If the comparator 13 operates as described hereinabove with reference to FIG. 4, it is necessary to connect an inverter between the output terminal of the comparator 13 and first and second AND gate circuits AND1 and AND2. The operation of other circuits is the same as described hereinbefore with reference to FIG. 2.

As described hereinbefore, a plasma ignition system according to the present invention having a plasma ignition plug located within each engine cylinder, comprises a plurality of transformers (T), each havng a primary winding (LP) one terminal of which is grounded to a side electrode of the plasma ignition plug and another terminal connected to one end of a first capacitor and to an anode of a second diode having a grounded cathode. Each transformer has a secondary winding (LS), one terminal of which is connected to a central electrode of the transformer and another terminal of which is connected to one of plural second capacitors. The number of the second capacitors is half that of the engine cylinders. A plurality of switching circuits (SCR11 through SCR14), each of which selectively grounds the other end of the corresponding first capacitor, feeds spark discharging energy stored on the first capacitor to the plasma ignition plug in response to a trigger signal applied to it. The system includes a plurality of further switching circuits (SCR15 and SCR16), the number of which is half that of the engine cylinders. Each of the further switching circuits selectively grounds the other end of the corresponding second capacitor so as to feed arc discharging energy stored on the second capacitor to the plasma ignition plug during a predetermined interval of time after the spark discharge occurs in the plug. The further switching circuits respond to another trigger signal that is delayed by the predetermined interval of time with respect to the former trigger signal. Therefore, the charging operation of the first capacitors can be achieved even when the engine rotates at a higher speed becuse a smaller amount of energy is stored by the first capacitors and the plasma ignition plug can generate at least a spark discharge even in such a region as described above. That ignition for an air-fuel mixture is carried out in each engine cylinder without failure of fuel combustion for every region of the engine speed and engine characteristics become more stable. In addition, since the numbers of the second capacitors and latter switching circuits (thyristors) are reduced to half the number of engine cylinders, the entire system is smaller in size and inexpensive in assembly cost in view of the high voltage withstanding characteristics required for the second capacitors and switching circuits (thyrisors).

The engine performance is increased since a preferable ignition characteristic is met with the individual characteristics of the plasma ignition plugs and engine since the spark discharge and arc discharge operations are carried out with two separate switching circuits.

It will be fully appreciated that the foregoing relates to only preferred embodiments of the present invention herein chosen for the purpose of the disclosure, which do not constitute departures from the spirit and scope of the present invention. The scope of the present invention, therefore, is to be determined by the following claims.

What is claimed is:

1. A plasma ignition system for an internal combustion engine having a plurality of engine cylinders each of which is provided with a plasma ignition plug, which comprises:

(a) power supply means for separately generating and deriving first and second high DC voltages, the first high DC voltage being higher than the second high DC voltage;

(b) a first switching unit for sequentially applying the first high DC voltage generated by said power supply means across one of the plasma ignition plugs according to a predetermined ignition order so that an insulation breakdown occurs in the plasma ignition plug due to a spark discharge in response to the application of the first high DC voltage at every ignition timing; and (c) a second switching unit for applying the second high DC voltage across the same plasma ignition plug that is responsive to the first high DC voltage, the second high DC voltage being applied to the plug while the first high voltage is applied to the plug and after the first high voltage is initially applied to the plug by a predetermined time delay so as to provide plasma ignition energy of the generated second high DC voltage for the plasma ignition plug, the supply of plasma ignition energy being effectd only while the engine speed is lower than a predetermined speed.

2. A plasma ignition system as set forth in claim 1 wherein said power supply means comprises:

(a) a low DC voltage supply;

(b) a first DC-DC converter for inverting the low DC voltage from said low DC voltage supply into a corresponding AC voltage and converting the AC voltage into a third high DC voltage;

(c) a plurality of first capacitors connected to be charged to the third high DC voltage derived from said first DC—DC converter;

(d) a plurality of transformers, each having a first primary winding connected to one of said first capacitors and a second primary winding connected to one electrode of one of the plasma ignition plugs, each of the transformers boosting the third high DC voltage applied across said first primary winding thereof to the first high DC voltage at a secondary winding thereof when said first switching unit turns on, whereby the third high DC voltage is discharged and boosted into the first high DC voltage by each of said transformers;

(e) a second DC—DC converter for inverting the low DC voltage supply into a corresponding second AC voltage and converting the second AC voltage into the second high DC voltage; and (f) a plurality of second capacitors, each connected between said second DC—DC converter and several of the secondary windings of said transfomers connected to be charged to the second high DC voltage derived from said second DC—DC converter while said second switching unit is turned off, the several windings being less than the plurality of secondary windings, the connection of one of said second capacitors to the secondary windings of said transformers being such that one engine cylinder related to one secondary winding is at the start of an explosion stroke of the engine while the other engine cylinders related to the other secondary windings are at the end of an exhaust stroke of the engine, whereby the number of said second capacitors is half that of said first capacitors.

3. A plasma ignition system as set forth in claim 2, wherein said first switching unit comprises a plurality of switching elements, one end of each switching element being connected to said first DC—DC converter in parallel with one of said first capacitors and another end thereof being connected to another electrode of one of the plasma ignition plugs, each of which turns on in response to a first trigger pulse being supplied thereto according to a predetermined ignition order and said second switching unit comprises a plurality of switching elements, one end of each switching element of said second switching units being connected to said second DC—DC converter in parallel with one of said second capacitors and the other end thereof being connected to the another electrode of one of the plasma ignition plugs, each of which turns on in response to a second trigger pulse being supplied thereto, said second trigger pulse being supplied with a predetermined time delay after said first trigger pulse is supplied to one of said switching elements of said first switching unit.

4. A plasma ignition system as set forth in claim 3, wherein said switching elements of both first and second switching units are thyristors.

5. A plasma ignition system as set forth in claim 3, which further comprises a detector for detecting the engine speed and deriving a signal in response to the engine speed increasing and exceeding a predetermined value, the signal derived by the detector being supplied to said second DC—DC converter of said power supply means to discontinue the derivation of the second high DC voltage so that the plasma ignition energy of the second high DC voltage is not supplied to the plasma ignition plugs.

6. A plasma ignition system as set forth in claim 3 which further comprises a detector for detecting the engine speed and deriving a signal in response to the engine speed increasing and exceeding a predetermined value, the signal derived by the detector being supplied to said switching elements of said second switching unit to disable turning on of said switching elements in response to the second trigger pulse so that the plasma ignition energy of the second high DC voltage is not supplied to the plasma ignition plugs.

7. A plasma ignition system as set forth in claim 3 wherein said first and second DC—DC converters of said power supply means have a common DC-AC inverting circuit for inverting the low DC voltage from said low DC voltage supply into a common AC voltage and a common transformer for boosting the common AC voltage into (a) a first high AC voltage having an amplitude substantially equal to said first high DC voltage and (b) a second high AC voltage having an amplitude substantially equal to said second high DC voltage.

8. A plasma ignition system for an internal combustion engine having N engine cylinders, where N is an even integer greater than one, comprising:

(a) N ignition plugs, each provided in one of the cylinders with one electrode thereof grounded;

(b) a low voltage DC power supply;

(c) a first DC—DC converter connected to said low voltage DC power supply for inverting a low DC voltage from said low voltage DC power supply to a first AC voltage and for boosting and converting the first AC voltage to a first predetermined DC voltage;

(d) a second DC—DC converter connected to said low voltge DC power supply for inverting a low DC voltage from said low DC power supply into a second AC voltage for boosting and converting the second AC voltage into a second predetermined DC voltage, said second predetermined DC voltage being higher than said first predetermined DC voltage;

(e) N first capacitors connected to said first DC-DC converter, each being fully charged to the first predetermined DC voltage supplied from said first DC—DC converter;

(f) N first switching circuits each respectively connected to one of said first N capacitors for grounding one end of said corresponding first capacitor fully charged to the first predetermined DC voltage, the other end of said corresponding first capacitor floating with respect to ground in response to a first trigger signal applied thereto;

(g) N transformers, each having a primary winding and a secondary winding, one terminal of each primary winding thereof being grounded and another terminal of each primary winding being connected to the other end of said corresponding first capacitor and one terminal of each secondary winding being connected to the other electrode of one of the corresponding plasma ignition plugs;

(h) N/2 second capacitors connected to said second DC—DC converter, each being fully charged to the second predetermined DC voltage supplied from said second DC-DC converter;

(i) N/2 second switching circuits, each connected between one of said second capacitors and the other terminals of the secondary windings of at least two of said transformers to which the respective plasma ignition plugs located within the corresponding engine cylinders are connected in such a way that one engine cylinder is at the start of an explosive stroke of the engine while the other engine cylinder is at almost the end of an exhaust stroke of the engine;

(j) a first trigger signal generator for sequentially generating and supplying a first trigger signal to one of said first switching circuits according to a predetermined ignition order; and (k) a second trigger signal generator for generating and supplying a second trigger signal to one of said second switching circuits with a predetermined time delay after said first trigger signal generator supplies the first trigger signal to a corresponding one of said first switching circuits.